US008701945B2

(12) United States Patent
Hoagland et al.

(10) Patent No.: US 8,701,945 B2
(45) Date of Patent: Apr. 22, 2014

(54) COMPRESSED FLUID DISPENSING DEVICE WITH INTERNAL SEAL

(75) Inventors: Mary M. Hoagland, Midland, MI (US); Peter J. Schulz, Midland, MI (US); Christopher J. Siler, Hemlock, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/982,495

(22) PCT Filed: Feb. 16, 2012

(86) PCT No.: PCT/US2012/025333

§ 371 (c)(1),
(2), (4) Date: Jul. 30, 2013

(87) PCT Pub. No.: WO2012/115842

PCT Pub. Date: Aug. 30, 2012

(65) Prior Publication Data

US 2013/0320044 A1 Dec. 5, 2013

Related U.S. Application Data

(60) Provisional application No. 61/446,644, filed on Feb. 25, 2011.

(51) Int. Cl.
*B65D 83/14* (2006.01)
*B65D 47/30* (2006.01)

(52) U.S. Cl.
USPC ..... 222/402.13; 222/402.22; 222/402.25

(58) Field of Classification Search
USPC ..... 222/501, 529, 528, 548, 549, 402.13, 222/329, 530, 153.1, 153.11, 153.14, 525, 222/514, 518, 500, 402.15, 402.21, 402.22, 222/402.23, 510; 215/329, 342, 314, 315, 215/311
See application file for complete search history.

(56) References Cited

U.S. PATENT DOCUMENTS 3,249,267 A 5/1966 Carrion, Jr. et al.
3,357,604 A * 12/1967 Barker ..... 222/402.23

(Continued)

FOREIGN PATENT DOCUMENTS

DE 3606018 6/1987
EP 1867396 12/2007

(Continued)

OTHER PUBLICATIONS

Great Stuff Pro Foam Dispensing Guns, pp. 1-6, The Dow Chemical Company, Midland, MI.

*Primary Examiner* — Paul R Durand
*Assistant Examiner* — Charles P Cheyney
(74) *Attorney, Agent, or Firm* — Steven W. Mork

(57) ABSTRACT

A dispensing device (10) for dispensing compressed fluid from a can (100) through a valve stem (110) of the can, the dispensing device containing a hollow tube (20) defining a channel (22) there-through, a connector (40) defining a conduit (46) there-through that is in fluid communication with the channel of the hollow tube, a plug (30) located in the channel of the hollow tube that is able to move in the channel of the hollow tube and seal the hollow tube from fluid flow when pressed towards the dispensing end (24) of the hollow tube (22), a sealed port between the inside and outside of the dispensing device and a flexible and inelastic extension piece (50) attached to the plug and extending through the channel of the hollow tube and, optionally, the conduit of the connector then out from the dispensing device through the sealed port and capable of attaching to a can (100) to which the dispensing device (100) is connected.

9 Claims, 2 Drawing Sheets

(56) References Cited

U.S. PATENT DOCUMENTS

| | | | | | |
|---|---|---|---|---|---|
| 3,419,197 | A | * | 12/1968 | Battaglia | 222/485 |
| 3,506,165 | A | * | 4/1970 | Beard | 222/402.22 |
| 3,920,165 | A | * | 11/1975 | Schultz | 222/402.23 |
| 4,008,834 | A | * | 2/1977 | Towns | 222/402.23 |
| 4,418,847 | A | * | 12/1983 | Beard | 222/402.23 |
| 4,860,933 | A | * | 8/1989 | Morane et al. | 222/402.13 |
| 4,895,280 | A | | 1/1990 | Tourigny | |
| 5,085,353 | A | * | 2/1992 | Inui et al. | 222/402.13 |
| 5,205,443 | A | * | 4/1993 | Inui et al. | 222/402.13 |
| 5,305,930 | A | * | 4/1994 | De Laforcade | 222/402.13 |
| 5,423,458 | A | | 6/1995 | Tourigny | |
| 5,533,649 | A | | 7/1996 | Von Schuckmann | |
| 5,549,226 | A | | 8/1996 | Kopp | |
| 5,772,077 | A | * | 6/1998 | Tafur | 222/192 |
| 6,213,351 | B1 | | 4/2001 | Stoneberg et al. | |
| 6,431,465 | B1 | | 8/2002 | Yie | |
| 8,281,962 | B2 | | 10/2012 | Ogawa et al. | |

FOREIGN PATENT DOCUMENTS

| | | |
|---|---|---|
| FR | 2764774 | 12/1998 |
| WO | 9843913 | 10/1998 |
| WO | 2005120987 | 12/2005 |

* cited by examiner

Figure 2
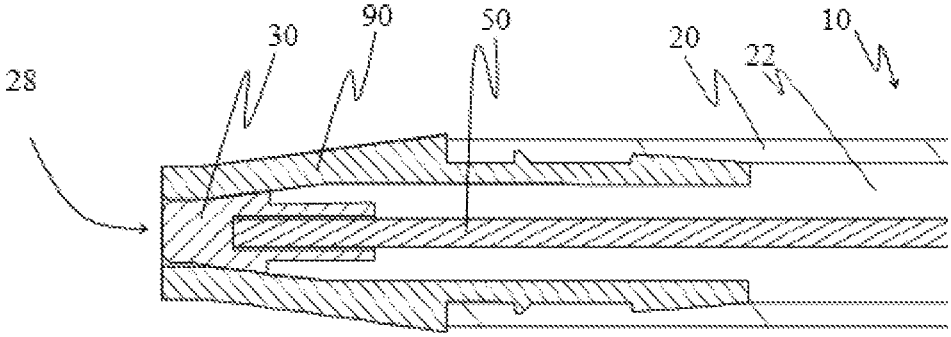
Figure 3(a)
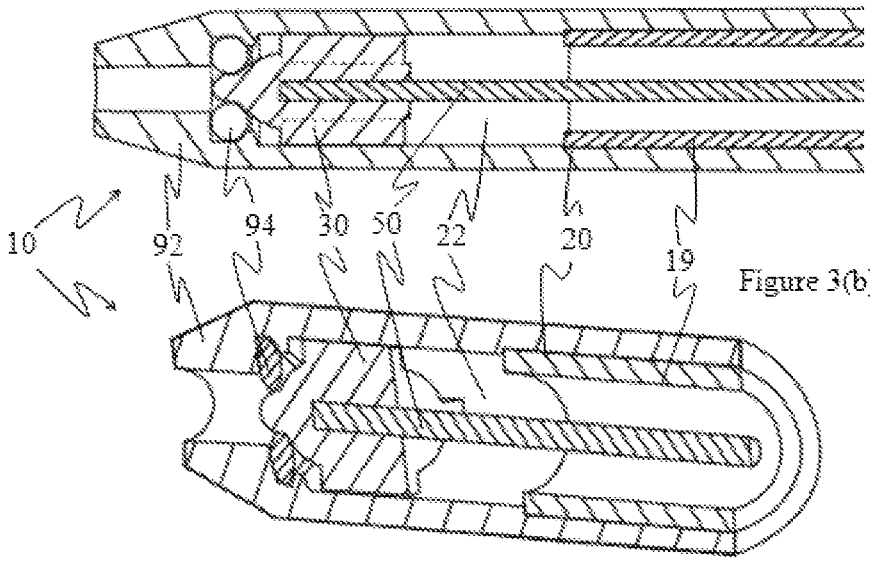
Figure 3(b)

COMPRESSED FLUID DISPENSING DEVICE WITH INTERNAL SEAL

BACKGROUND OF THE INVENTION

1. Field of the Invention

The present invention relates to a dispensing device for dispensing compressed fluid from a can and a dispensing system comprising the dispensing device and can.

2. Description of Related Art

Dispensing fluid, particularly expandable fluid, from a compressed can is useful for many do-it-yourself products. One product in particular is spray foam for sealing and thermal insulation applications. Spray foam is available as a foamable liquid under pressure in a can. It is common to dispense the foamable liquid through an application tube (or straw) attached to a valve on the can. Upon release from the can the foamable liquid expands into foam and fills gaps and/or provides a thermal insulating seal. Foamable liquids include foamable latex and foamable polyurethane formulations.

One challenge with spray foams is that residual foamable formulation in the application tube of the dispenser is free to continue to expand after applying the spray foam formulation to a location. As a result, residual foamable liquid continues to expel from the application tube even after application of the foamable liquid is complete. The expanding residual foamable liquid can drip from the application tube to create unintended messes. Alternatively, the user must continually wipe clean the dispensing end of the application tube as residual foamable liquid expands within the tube. To avoid drips and the need to continually wipe the end of an application tube, it would be desirable to have a dispensing device for use with compressed expandable liquids that would obviate continuous expansion of residual foamable liquid out from an application tube after desired application of the foamable liquid is complete.

U.S. Pat. No. 5,549,226 ('226) discloses a device for operating propellant cans that can be useful for addressing the aforementioned problem. The device in '226 comprises a bendable application tube that can bend back on itself and the open end of the straw placed over a nipple to seal it. Inserting a nipple into the end of an application tube will itself displace fluid out from the application tube around the nipple resulting in foam being undesirably disposed around the nipple area and possibly the fingers of a user inserting the tube over the nipple. In contrast to the device of '226, it is desirable to avoid having to insert anything into the end of the dispensing tube in order to seal the end. That is, it is desirable to be able to seal the dispensing end of the dispensing tube from inside the tube.

The Dow Chemical Company offers a foam dispensing gun for GREAT STUFF PRO™ brand spray foam. The spray gun is available in three different grades: PRO 13, PRO 14 and PRO 15. Each of the guns has a port onto which a can of GREAT STUFF PRO™ brand spray foam attaches thereby releasing the compressed foam formulation into a barrel of the gun. Extending through the barrel is a rod that is spring loaded to seal from inside the barrel an outlet or dispensing end of the barrel. A trigger is attached to the spring loaded rod so that upon pulling the trigger the rod is retracted from the dispensing end of the barrel and foam formulation is free to flow from the can through the barrel around the retracted rod and out from the dispensing end. Upon release of the trigger the spring repositions the rod back into sealing position in the dispensing end of the barrel. This dispensing gun design requires a spring-loaded rod to achieve internal sealing of the dispensing device. Including a spring increases cost and complexity during manufacturing. It is desirable to have a dispensing device capable of sealing from the inside but without requiring a spring-loaded rod.

BRIEF SUMMARY OF THE INVENTION

The present invention provides a dispensing device for compressed fluids that can seal the application tube from inside the device thereby resolving the problem of expandable foamable mixtures from continuing to expel from the application tube while avoiding having to insert something into the end of the dispensing tube or having a spring-loaded rod extending through barrel of the dispensing device. Moreover, certain embodiments of the present invention are capable of automatically unsealing the dispensing tube while applying a compressed foamable liquid and then automatically sealing the application end of the dispensing tube upon ceasing to apply the foamable liquid. With such an embodiment, a user can avoid having to put their hands near the dispensing tube to seal or unseal it and thereby can avoid getting foam on their hands.

In a first aspect, the present invention is a dispensing device for dispensing compressed fluids from a can through a valve stem of the can, the dispensing device comprising: (a) a hollow tube having opposing entrance and dispensing ends, the hollow tube defining a channel entirely through the tube from the entrance end to the dispensing end; (b) a connector defining a conduit there-through with one end of the conduit mating with the channel of the hollow tube to provide fluid communication through the conduit and channel and where the opposing end of the conduit is capable of attaching to the valve stem of the can; (c) a plug located in and able to move within the channel of the hollow tube, wherein the plug and hollow tube mate in a sealing configuration that seals the channel from fluid flow when the plug is pressed towards the dispensing end of the hollow tube; (d) a flexible and inelastic extension piece having opposing first and second ends with the first end attached to the plug, the extension piece extending through at least part of the channel of the hollow tube and optionally through at least part of the connector conduit; and (e) a sealed port defined in the hollow tube, the connector or both and through which the flexible and inelastic extension piece extends from inside the channel or conduit to outside of the dispensing device; wherein the second end of the flexible and inelastic extension piece is attachable to the can, and wherein the extension piece is long enough so that when the connector is attached to the valve stem of a can the plug can be in a sealing configuration when the extension piece is attached to the can but short enough so that when the connector and valve stem are tilted away from the extension piece with respect to the can the plug becomes displaced from its sealing configuration, and wherein the dispensing device is free of a spring that presses the plug into sealing configuration.

In a second aspect, the present invention is a foam dispensing system comprising a can of compressed foamable formulation and the dispensing device of the first aspect, wherein the can has a valve stem to which the connector of the dispensing device can attach.

The dispensing device of the present invention is useful for dispensing compressed liquid, especially compressed foamable liquid from a can.

BRIEF DESCRIPTION OF THE DRAWINGS

FIG. 2 illustrates a cut-away view of one example of a dispensing end of a dispensing device of the present invention.

FIGS. 3(*a*) and 3(*b*) illustrate cut-away views of an example of a dispensing end of a dispensing device of the present invention. FIG. 3(*a*) is a side-on cut-away view. FIG. 3(*b*) is an angled cut-away view.

DETAILED DESCRIPTION OF THE INVENTION

Figure 1:
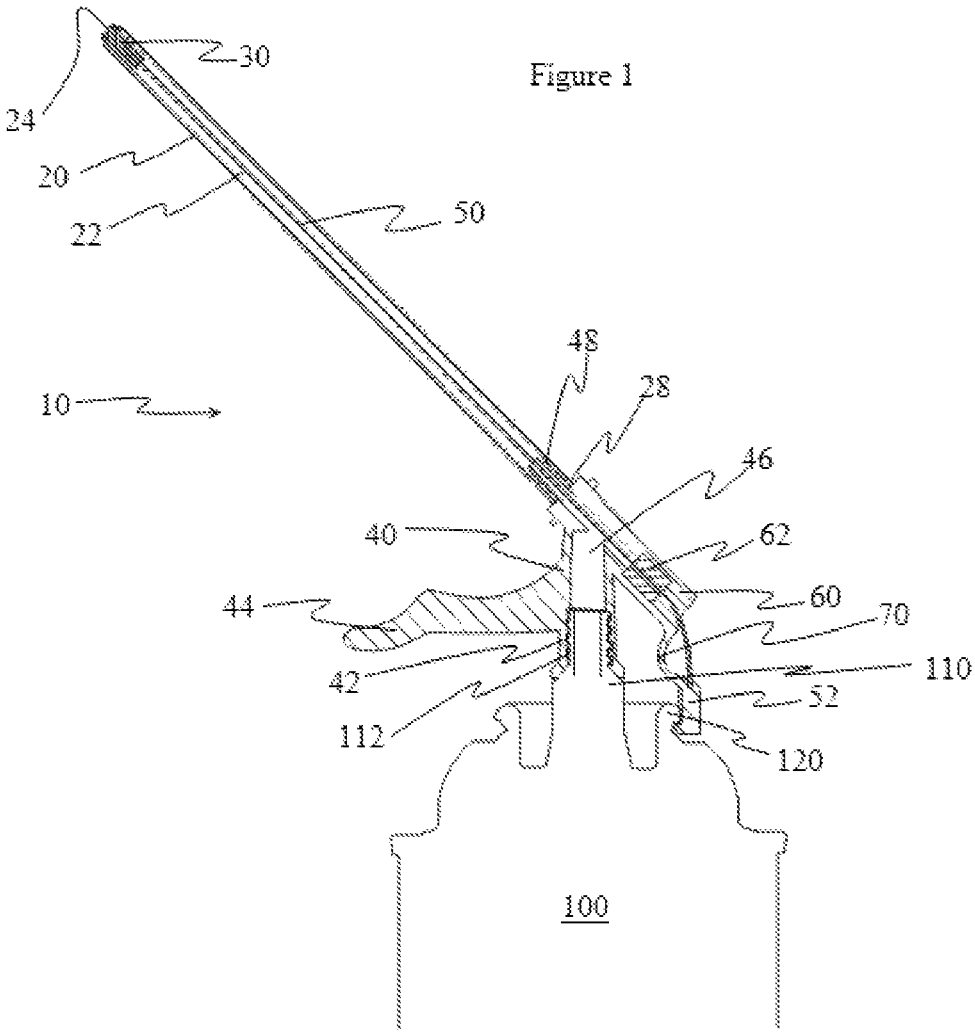
FIG. 1 illustrates a cut-away view of a dispensing device of the present invention attached to a can.

"And/or" means "and, or as an alternative". "Multiple" means "two or more". All ranges include endpoints unless otherwise indicated.

Applicants anticipate that aspects of any embodiment are combinable in an unlimited fashion with any aspects of any other embodiments unless such a combination is physically impossible.

The present invention is a dispensing device for dispensing compressed fluids from a can through a valve stem of the can. In the broadest scope of the invention, the type of compressed fluid is unlimited and can include both liquids and gases. However, the present invention is particularly useful for dispensing compressed foamable formulations. Foamable formulations typically comprise a mixture of matrix material and blowing agent that is held under sufficient pressure to preclude expansion of the blowing agent until foaming is desired. Upon release of the pressure the blowing agent can expand within the matrix material to create foam. Common foamable polymer compositions include those having a matrix that forms a polyurethane polymer upon expanding and curing (that is, polyurethane foamable polymer compositions). Another type of foamable polymer composition comprises a latex matrix material that foams during expansion and coalesces to form polymer foam.

Cans of compressed fluid suitable for use with the present invention have a valve and valve stem through which contents within the can are dispensed. The valve of the can is the part of the can that reversibly seals and unseals to close or open the can for dispensing fluid from the can. The valve stem is a part to the valve that extends from the sealing portion of the valve and is typically tubular so the contents of the can are able to expel through the valve stem.

The dispensing device comprises a hollow tube that defines a channel there through. The tube has opposing entrance and dispensing ends and the channel extends all the way through the hollow tube from the entrance end to dispensing end. Fluid can enter the channel of the hollow tube through the entrance end and is able to flow through the channel of the tube and out from the channel through the dispensing end. The hollow tube and channel can have the same or different cross sectional shapes and can each be any conceivable cross sectional shape. Cross sections lie in a plane perpendicular to a line extending centrally through the channel from the entrance to dispensing end. Typically, both the hollow tube and channel both have a circular cross sectional shape. The cross sectional area of the channel can, and desirably does, taper down in size proximate to the dispensing end. The cross sectional area of the channel can, alternatively, suddenly reduce in size in a step-wise fashion at or proximate to the dispensing end. Having a smaller cross sectional area proximate to the dispensing end is desirable to help facilitate sealing the channel with a plug as described further below. The hollow tube can be of any conceivable shape including straight or curved, although straight (that is, extending in a straight line from entrance end to dispensing end) is typical. The hollow tube can comprise a single piece or multiple pieces. For example, the hollow tube can comprise removable tips that attach to the hollow tube and serve as the dispensing end of the hollow tube. The removable tips can be designed to constrict and/or redefine the direction or shape of fluid flow from the channel of the hollow tube through the dispensing end. For example, the tip can distribute the flow of fluid into a fan pattern to facilitate application of fluid over a wide surface area. The tip can also constrict fluid flow by reducing the cross sectional area of the dispensing end of the channel, which can be useful if the plug (discussed below) is designed to mate with the removable tip to form a seal when pressed against the removable tip.

Desirably, the hollow tube is made of material that is relatively inert to the compressed fluid that is dispensed through it so that the hollow tube does not deteriorate or decompose during use. The hollow tube is desirably plastic but can be made of for example, metal or a combination of plastic and metal components. Suitable plastic materials include polyethylene and polypropylene. Suitable metals include aluminum and stainless steel.

The hollow tube mates with a connector that provides an interface, or linking device, between the hollow tube and the valve stem of a can of compressed fluid. The connector defines a conduit (or, a channel) through it. The conduit has at least, and preferably has only, two openings or ends to the outside of the connector not including a sealed port as described below. One of the openings mates the channel of the hollow tube with the conduit of the connector. The other opening of the conduit attaches to and mates with the valve stem of a can. The hollow tube "mates" or is "mated" with the connector, which means that the entrance end of the hollow tube connects to the connector in such a way that the channel through the hollow tube is in fluid communication with the conduit through the connector through one end of the conduit. The channel of the hollow tube essentially serves as a continuation of the conduit through the connector.

The hollow tube and connector can be a single piece or multiple pieces. As a single piece the hollow tube and connector are either permanently connected or formed (for example, molded) as a single piece. As multiple pieces, the hollow tube can be separable from the connector. For example, the hollow tube can be a straw with an entrance end that fits over a nipple defined in the connector so that once the straw is put over the nipple the channel of the straw and the conduit of the connector are in fluid communication.

The connector can be made of the same material as the hollow tube or different material. However, the connector is generally made from the same types of materials that are suitable for the hollow tube.

The opening of the conduit that attaches to the valve stem of a can mates with the valve stem when the dispensing device is attached to a can, which means the conduit of the connector forms a sealed connection with the valve stem of the can so there is fluid communication through the valve stem into the conduit of the connector. Therefore, when the dispensing device is attached to a can there is fluid communication through the valve stem into and through the conduit of the connector and into the channel of the hollow tube. For example, outer (exposed) walls of the valve stem and inside walls of the connector conduit can have mating threads such that the connector can screw onto and over the valve stem to attach the dispensing device to the can. The connector can attach to the valve stem by any possible means provided that there is fluid communication through the valve stem and into the conduit of the connector. Other possible means of attaching a connector to a valve stem include frictional mating (connector slides over valve stem with friction holding it in place), snapping the connector over a valve stem in such a manner the valve stem in such a manner that the two reversibly, or non-reversibly, lock together. Locking means include mating ridge and groove features where the ridge of one piece fits into the groove of another to lock them together. Locking means can alternatively (or additionally) include a protuberance on one piece that slides within a slot on another piece wherein the slot has a side section allowing twisting of the two pieces with respect to one another to place the protuberance into the side section to lock the pieces into place with respect to one another.

The connector can comprise a trigger. Desirably, the trigger extends off from one side of the connector so that when the connector is attached to the valve stem of a can pulling the trigger tilts the connector and valve stem in the valve allowing compressed fluid to be released through the valve and valve stem into the conduit of the connector. An alternative trigger design includes a trigger structure symmetrically defined about the connector so that applying pressure to the trigger structure pushes the valve stem into the valve without tilting thereby opening the valve to release compressed fluid in the can to flow through the valve and valve stem into the conduit of the connector.

A plug is located within the channel of the hollow tube. The plug can move within the channel of the hollow tube when there is an absence of fluid in the hollow tube applying pressure against the plug. The plug is designed to mate in a sealing configuration with the hollow tube when the plug is pressed towards the dispensing end of the hollow tube. When the plug and hollow tube mate in a sealing configuration the plug can, for example, contact the hollow tube walls (that portion of the hollow tube around the channel) or a component or components within the hollow tube (for example, an O-ring or gasket set in a recess within the wall of the hollow tube and exposed within the channel). There are many options for such a plug and hollow tube design and one of ordinary skill in the art can readily conceive of manifestations of such designs. For example, the channel of the hollow tube can be tapered towards the dispensing end of the hollow tube so that as the plug is pressed towards the dispensing end the plug presses against the walls of the channel to seal off fluid communication past the plug. Additionally, or alternatively, there may be a constriction, even a step-wise constriction, at or proximate to the dispensing end that defines an aperture through the channel that has a cross sectional area that is smaller than previous cross sectional areas in the channel and the plug can fit into the aperture so as to seal the aperture when pressed towards the dispensing end. As previously noted, the dispensing end can comprise a removable tip that is designed to mate in a sealing configuration with the plug when the plug is pressed into the removable tip. The hollow tube can comprise an O-ring within the channel, desirably inset into a recess of the hollow tube wall defining the channel, against which the plug presses when in a sealed configuration.

While the plug is of sufficiently large dimensions to form a sealing configuration when pressed towards the dispensing end of the hollow tube, it is also of sufficiently small dimensions to allow fluid to flow through the channel and around the plug when not in a sealing configuration. For example, the channel can have a circular cross section with a main diameter that reduces to a reduced diameter at the dispensing end while the plug has a circular cross sectional with a diameter that is smaller than the main diameter and larger than the reduced diameter of the hollow tube channel. In such an example, the plug forms a sealing configuration with the channel when pressed towards the dispensing end because it has a larger diameter than the channel at the dispensing end. However, when displaced away from the dispensing end into a portion of the channel having a main diameter there is fluid communication around the plug within the channel. It is straightforward to extend this example to other cross sectional shapes beyond circular by, for example, using similar concepts of proportions of cross sectional shapes between the plug and sections of the hollow tube channel.

In its broadest scope, the plug can be a spherical shape or can have a length that exceeds its cross sectional dimensions. Desirably, the plug has a length that exceeds its cross sectional dimensions. Still more preferably, the plug has a length that exceeds the cross sectional dimensions of the channel. For avoidance of any doubt, the length of the plug extends in a direction perpendicular to the cross section of the plug and hollow tube and parallel to the direction fluid flows in the hollow tube when flowing from the entrance end to the dispensing end.

It is desirable for the end of the plug most remote from the dispensing end of the hollow tube to have as large of a cross sectional area as possible so that expanding fluid within the hollow tube most efficiently applies pressure against the plug and presses the plug into a sealing configuration when the plug is not held in a non-sealing configuration.

At least a portion of the plug, the portion that makes contact with the hollow tube to form a seal when in a sealing configuration, is desirably elastically deformable so that it can conform to the shape of the channel cross section as it is pressed against the hollow tube when in a sealing configuration. The entire plug can be elastically deformable. Elastically deformable means that it can change shape when placed under force but can return to its original shape when the force is removed. Elastically deformable material suitable for the plug, or at least the portion that is elastically deformable, includes rubber, silicone, and plastic. The portion of the hollow tube with which the plug forms a seal when in a sealing configuration (for example, the hollow tube wall around the channel or O-ring or gasket material against which the plug presses when in a sealing configuration) can also, or alternatively, be elastically deformable. For instance, the hollow tube can comprise an elastic O-ring inset into the wall of the hollow tube and extending partially into the channel of the hollow tube. The plug, whether rigid or elastically deformable, can press against the O-ring when in a sealing configuration in order to seal off the channel. The O-ring can be rigid or elastically deformable (made of an elastically deformable material as described for the plug). Desirably, at least one of the O-ring and plug is elastically deformable.

The dispensing device further comprises a flexible (that is, bendable) and inelastic (that is, unable to return to its original shape within ten seconds after being stretched to more than 110% in its largest dimension) extension piece that has opposing first and second ends. The first end of the extension piece is attached to the plug within the channel of the hollow tube. The extension piece is desirably attached to the plug remotely from the portion of the plug that forms a seal with the walls of the channel when the plug is in a sealing configuration. The extension piece extends from the plug through the channel of the hollow tube behind the plug (that is, from the plug in the direction away from the dispensing end of the hollow tube) and desirably into the conduit of the connector. If the extension piece does not extend into the conduit of the connector, the extension piece extends out of the channel and hollow tube through a sealed port in the wall of the channel. If the extension piece extends from the channel into the conduit of the connector, the conduit extends out from the conduit and connector through a sealed port other than where the conduit attaches to a valve stem of a can. Conceivably, the extension piece can extend out from both the channel of the hollow tube and conduit of the connector if, for instance, the entrance end of the hollow tube fits over a nipple of the connector and the sealed port extends through both the hollow tube and nipple of the connector.

A sealed port is an opening into the hollow tube, connector or both that provides access from inside the dispensing device (that is, from the channel of the hollow tube and/or the conduit of the connector) to the outside of the dispensing device. The sealed port accommodates the extension piece so that when the extension piece is extending through the sealed port there is a seal preventing fluid communication between the outside and inside of the dispensing device during application of compressed fluid from a can through the dispensing device. For example, a suitable sealed port can comprise gasketing material that conforms to an extension piece extending through the sealed port and seals the sealed port. Suitable gasketing material includes rubber, plastic and silicone materials. The sealed port can, for example, comprise a gasketing material in the form of a sheet, film, o-ring, plug, or other form. The gasketing material can be inside the dispensing device (for example, within the channel and/or conduit), outside the dispensing device, between the inside and outside of the dispensing device (that is, within the wall of the hollow tube and/or connector), or any combination thereof.

It is desirable for the gasketing material to seal around the extension piece to prevent fluid leaking out from the dispensing device, but not seal so tightly that the extension piece cannot slide back and forth through the sealed port. In particular, the extension piece should be able to be pulled through the sealed port to displace the plug from a sealing configuration for dispensing fluid through the dispensing device. It is also desirable for the pressure of the fluid in the dispensing device, particularly if the pressure originates from expanding foamable fluid in the channel of the dispensing device, to be sufficient to push the plug back into a sealing configuration and at the same time pull the extension piece through the sealed port to accomplish moving the plug upon closing the valve of the can.

The extension piece extends through the sealed port a sufficient distance so as to be able to attach to a can when the dispensing device is attached to the valve stem of the can while the plug is in a sealing configuration. The second end of the extension piece attaches to the can when the dispensing device is attached to a valve stem of a can. The second end, for example, can comprise a clip that attaches to a valve skirt of a can, for instance. The extension piece is short enough so that when the dispensing device is attached to the valve stem of the can and the extension piece is attached to the can then bending the dispensing device and valve stem away from where the extension piece attached to the can (thereby, opening the valve of the can) causes the extension piece to displace the plug from a sealing configuration, if it was in a sealing configuration, and prevents the plug from entering its sealing configuration.

The extension piece remains movably independent from the hollow tube and connector. "Moveably independent" means one can move apart from the other. If the connector comprises a trigger, the extension piece extends on an opposite side of the dispensing device from the trigger. That way, when pressure is applied to the trigger causing the connector, hollow tube and valve stem to tilt with respect to the can the extension piece pulls the hollow plug from a sealing configuration within the channel of the hollow tube.

The extension piece can be or can comprise any one or combination of metal and plastic materials. Desirably, the extension piece is non-reactive with the fluid the dispensing device dispenses because the fluid will contact the extension piece that resides within the channel of the hollow tube. Generally, the materials suitable for the hollow tube are also suitable for the extension piece.

The extension piece can be a material that buckles under length-wise compressive load; that is, when compressive load is applied to the end of the extension piece remote from the plug and along its length before the compressive load moves the plug. For example, the extension piece can be a string. Such a string can comprise fibers (natural or synthetic) or be a single strand or fiber of material (natural or synthetic). Synthetic fibers include polymeric fibers.

The dispensing device can and desirably does further comprise a flexible connection piece between the connector and extension piece. The flexible connection piece holds the extension piece in a desired orientation with respect to the rest of the dispensing device (for example, opposite from a trigger on the connector) while still allowing the extension piece to be movably independent from the connector. The flexible connection piece can be, for example, a flexible plastic or metal ribbon, strip or wire in a curved, corrugated or helical shape.

The present invention offers a dispensing device that, upon attaching the connector the valve stem of a can and the extension piece to the can, automatically unseals the dispensing end of the hollow tube upon tilting of the hollow tube, connector and valve stem relative to the can away from the location that the extension piece connects to the can. There is no need for a user to insert or remove anything from the dispensing end prior to tilting the dispensing device and valve stem relative to the can to dispense fluid from the can.

The plug automatically returns to a sealing configuration within the hollow tube upon restoring the valve stem and dispensing device to a non-tilted orientation relative to the can (that is, an orientation where the can valve is closed). Conceivably, the extension piece can push the plug back into a sealing configuration within the hollow tube channel when the dispensing device returns from its tilted position and the can valve is closed. However, the extension piece can be unable to affirmatively push the plug back into a sealing configuration without additional force beyond any pressure exerted by the extension piece directing the plug into the sealing configuration. For example, the extension piece can lack sufficient stiffness to push the plug into a sealing configuration within the hollow tube and/or gasketing material of the sealed port prevents the extension piece from pushing the plug into a sealing configuration on its own. If the extension piece is unable to affirmatively push the plug back into a sealing configuration on its own (that is, without force applied apart from the extension piece), then force applied to the plug by expanding fluid within the hollow presses the plug into a sealing configuration as long as the connector and valve stem are not tilted with respect to the can preventing the plug from reaching a sealed configuration. The expanding foamable fluid within the hollow tube automatically presses the plug into a sealing configuration to seal the hollow tube when the valve of the can shuts and the extension piece allows replacement of the plug into a sealing configuration. When an expandable fluid is dispensed through the dispensing device, expansion of the fluid remaining in the channel and conduit of the dispensing device after closing the can valve presses the plug into a sealing configuration in the channel.

As described, the dispensing device of the present invention automatically opens when dispensing foamable fluid from a can by tilting the connector and valve stem with respect to the can away from where the extension piece connects to the can and automatically seals from the inside when the connector and valve stem are returned from their tilted position and the valve of the can is closed. Tilting the connector and valve stem with respect to the can opens the valve of the can. Tilting the connector and valve stem away from where the extension piece connects to the can causes the extension piece to withdraw the plug from a sealing configuration within the hollow tube because the length of the extension piece does not extend far enough to allow the plug to remain in a sealed configuration. As a result, the hollow tube becomes open to dispense fluid from the can through the dispensing end of the hollow tube. Returning the connector and valve stem from a tilted position allows the can valve to close and the plug to reach a sealing configuration within the hollow tube. Expanding foamable fluid within the hollow tube helps to press the plug into its sealing configuration and close the hollow tube from fluid flow out from the dispensing end of the hollow tube.

One advantage the present invention has over prior art is that it can automatically and reversibly open and close without requiring a spring loaded rod that seals the hollow tube. In fact, the present invention can be free of a spring (that is, a resilient coil of metal or other material that can be elastically compressed or extended) or spring loaded mechanism that presses the plug into a sealing configuration and can be free of springs altogether. The dispensing device of the present invention can be free of any mechanical means that affirmatively presses the plug into a sealing configuration when the hollow tube is free of fluid.

The following figures illustrate aspects of dispensing devices of the present invention.

FIG. 1 illustrates a cut-away view of dispensing device 10 attached to can 100 via valve stem 110. Dispensing device 10 comprises hollow tube 20 that defines channel 22, which extends from dispensing end 24 to entrance end 28 of hollow tube 20. Hollow tube 20 mates with connector 40. In this particular example, hollow tube 20 is separable from connector 40 and mates with connector 40 by inserting nipple 48 of connector 40 into entrance end 28 of hollow tube 20. Connector 40 defines conduit 46, which extends through connector 40 and is in fluid communication with channel 22. Connector 40 mates with valve stem 110 by screwing onto valve stem 110. Connector 40 has threads 42 defined within conduit 46 that mate with threads 112 on valve stem 110 so that connector 40 can screw onto valve stem 112. Connector 40 comprises trigger 44 extending out from one side of connector 40 so that applying pressure to trigger 44 tilts connector 40 and valve stem 110 with respect to can 100. Plug 30 resides within channel 22 of hollow tube 20. FIG. 1 illustrates plug 30 in a sealing configuration within channel 22 of hollow tube 20. Plug 30 has a larger cross sectional diameter than the dispensing end 24 opening to channel 22. As a result, plug 30 seals channel 22 when pressed towards dispensing end 24. Flexible and inelastic extension piece 50 is attached to plug 30 remote from dispensing end 28 and extends within channel 22 and into conduit 46.

Connector 40 further comprises sealed port 60 through which extension piece 50 extends to exit conduit 46. Sealed port 60 comprises gasketing material 62 that prevents fluid from exiting conduit 46 through sealed port 60. Extension piece 50 continues from sealed port 60 to clip 52 that attaches to valve skirt 120. Flexible connection piece 70 connects clip 52 to connector 40 proximate to sealed port 60 to stabilize the position of clip 52 and extension piece 50 with respect to connector 40.

Clip 52 is on an opposite side of connector 40 so that pulling trigger 44 towards can 100 tilts connector 40 and valve stem 110 with respect to can 100 away from clip 52 causing extension piece 50 to pull plug 30 away from a sealed position and thereby allowing fluid communication around plug 30 and out from channel 22 through dispensing end 28. Releasing pressure from trigger 44 and returning of connector 40 and valve stem 110 to a non-tilted orientation with respect to can 100 allows extension piece 50, pressure from fluid within channel 22, or both extension piece 50 and pressure from fluid within channel 22 to press plug 30 into a sealing configuration.

FIG. 2 illustrates a close-up cut-away view of a portion of dispensing device 10 (which can be the same or different from dispensing device 10 of FIG. 1). FIG. 2 illustrates hollow tube 20, plug 30 within channel 22 and extension piece 50. Plug 30 is in a sealing configuration with dispensing end 28 of hollow tube 20. In this particular example, hollow tube 20 comprises removable tip 90. Removable tip 90 snaps into a portion of hollow tube 20 to create a tapered cross sectional area at dispensing end 28.

FIGS. 3(*a*) and (*b*) illustrate cut-away views of a portion of another example of a dispensing device 10 comprising channel 22, plug 30, extension piece 50 and a removable tip 92 that is different from that of removable tip 90 in FIG. 2. Removable tip 92 fits over the outside of straw-like tube 19 to form in combination hollow tube 20. Removable tip 92 comprises O-ring gasket 94 that extends into channel 20 and against which plug 30 presses when in the sealed configuration. FIGS. 3(*a*) and (*b*) illustrate dispensing device 10 with plug 30 in a sealing configuration. Plug 30 can be rigid in this type of dispensing device because O-ring gasket 94 can conform to the shape of plug 30 to ensure a good seal. Use of a removable tip like removable tip 92 can be desirable to facilitate construction of dispensing device 10. Removable tip 92 can lock onto straw-like tube 19 to ensure they do not come apart during use by any of many types of locking means (for example, mating ridge and groove profiles on the two pieces or a twist lock mechanism).

The features illustrated in the Figures are combinable and interchangeable with one another, as well as combinable and/or interchangeable with the various features and options described herein, to the extent such combinations are physically possible.

Another aspect of the present invention is a foam dispensing system comprising a can of compressed foamable formulation and the dispensing device described herein. The can has a valve stem to which the connector of the dispensing device can attach.

The invention claimed is:

1. A dispensing device for dispensing compressed fluids from a can through a valve stem of the can, the dispensing device comprising:

(a) a hollow tube having opposing entrance and dispensing ends, the hollow tube defining a channel entirely through the tube from the entrance end to the dispensing end;

(b) a connector defining a conduit there-through with one end of the conduit mating with the channel of the hollow tube to provide fluid communication through the conduit and channel and where the opposing end of the conduit is capable of attaching to the valve stem of the can;

(c) a plug located in and able to move within the channel of the hollow tube, wherein the plug and hollow tube mate in a sealing configuration that seals the channel from fluid flow when the plug is pressed towards the dispensing end of the hollow tube;

(d) a flexible and inelastic extension piece having opposing first and second ends with the first end attached to the plug, the extension piece extending through at least part of the channel of the hollow tube and optionally through at least part of the connector conduit; and (e) a sealed port defined in the hollow tube, the connector or both and through which the flexible and inelastic extension piece extends from inside the channel or conduit to outside of the dispensing device;

wherein the second end of the flexible and inelastic extension piece is attachable to the can, and wherein the extension piece is long enough so that when the connector is attached to the valve stem of a can the plug can be in a sealing configuration when the extension piece is attached to the can but short enough so that when the connector and valve stem are tilted away from the extension piece with respect to the can the plug is unable to be in its sealing configuration, and wherein the dispensing device is free of a spring that presses the plug into sealing configuration.

2. The dispensing device of claim 1, further characterized by the connector comprising a connector trigger extending out from the connector on a side opposite from the side the extension piece extends on the outside of the dispensing device.

3. The dispensing device of claim 1, wherein the second end of the extension piece comprises a clip capable of attaching to a valve skirt on the can.

4. The dispensing device of claim 1, further comprising a flexible connection between the extension piece and the connector proximate to the end of the conduit that attaches to the can valve stem.

5. The dispensing device of claim 1, further characterized by the extension piece being a material that buckles under length-wise compressive load; that is, when compressive load is applied to the end of the extension piece remote from the plug and along its length before the compressive load moves the plug.

6. The dispensing device of claim 1, further characterized by the channel through the hollow tube tapering to a smaller cross sectional area proximate to the dispensing end than the average cross sectional of the entire hollow tube.

7. The dispensing device of claim 1, further characterized by at least a portion of at least one of the plug and the hollow tube being elastically deformable wherein an elastically deformable portion of at least one of the plug and hollow tube participates in the mating between the plug and the hollow tube to form a seal when the plug is pressed into the sealing configuration.

8. The dispensing device of claim 1, further comprising guides on the outside surface of the dispensing device through which the extension piece extends.

9. A foam dispensing system comprising a can of compressed foamable formulation and the dispensing device of claim 1, wherein the can has a valve stem to which the connector of the dispensing device can attach.

* * * * *